US008761430B2

(12) United States Patent
Zimmerman

(10) Patent No.: US 8,761,430 B2
(45) Date of Patent: Jun. 24, 2014

(54) DECORATIVE SIGNAL TRANSDUCING APPARATUS

(75) Inventor: Mark Zimmerman, Florham Park, NJ (US)

(73) Assignee: PCS Wireless, LLC, Florham Park, NJ (US)

( * ) Notice: Subject to any disclaimer, the term of this patent is extended or adjusted under 35 U.S.C. 154(b) by 0 days.

(21) Appl. No.: 13/569,870

(22) Filed: Aug. 8, 2012

(65) Prior Publication Data

US 2013/0036766 A1 Feb. 14, 2013

Related U.S. Application Data

(60) Provisional application No. 61/521,636, filed on Aug. 9, 2011.

(51) Int. Cl.
*H04R 25/00* (2006.01)

(52) U.S. Cl.
USPC ..... 381/384; 381/374; 381/385

(58) Field of Classification Search
USPC ..... 381/309, 370, 374, 375, 376, 377, 379, 381/381, 382, 384, 301, 385; 379/430; 181/128, 129, 130, 135
See application file for complete search history.

(56) References Cited

U.S. PATENT DOCUMENTS

| | | | | |
|---|---|---|---|---|
| 3,667,569 | A * | 6/1972 | Mackey et al. | 181/135 |
| 5,008,984 | A | 4/1991 | Levy | |
| 6,473,946 | B1 | 11/2002 | Cheng | |
| 6,640,398 | B2 | 11/2003 | Hoffman | |
| 7,436,974 | B2 | 10/2008 | Harper | |
| 7,693,295 | B2 * | 4/2010 | Harper | 381/374 |
| 8,086,288 | B2 | 12/2011 | Klein | |
| 2001/0043711 | A1 * | 11/2001 | Hashimoto et al. | 381/370 |
| 2004/0209576 | A1 | 10/2004 | Lee | |
| 2007/0121987 | A1 * | 5/2007 | Fielding, Jr. | 381/385 |
| 2007/0291974 | A1 | 12/2007 | Eisenbraun | |
| 2008/0075316 | A1 | 3/2008 | Chan | |
| 2009/0016559 | A1 | 1/2009 | Cleary | |

OTHER PUBLICATIONS http://direct.motorola.com/hellomoto/h9/, Printed from the web on Aug. 1, 2012.

* cited by examiner

*Primary Examiner* — Huyen D Le
(74) *Attorney, Agent, or Firm* — Schenck, Price, Smith & King, LLP

(57) ABSTRACT

The present invention provides an item of jewelry containing headphones, or a headset, enabling a wearer to interface with electronic devices. In particular, the present invention provides a necklace containing headphones or a headset, enabling a wearer to interface with electronic devices.

1 Claim, 9 Drawing Sheets

DECORATIVE SIGNAL TRANSDUCING APPARATUS

This application claims priority to Provisional U.S. Patent Application Ser. No. 61/521,636, entitled "Decorative Signal Transducing Apparatus", filed Aug. 9, 2011.

FIELD OF THE INVENTION

The present invention provides an item of jewelry containing signal transducer, such as headphones, or a headset, enabling a wearer to interface with electronic devices. In a particular embodiment, the present invention provides a necklace containing headphones or a headset, enabling a wearer to interface with electronic devices.

BACKGROUND

Portable electronic devices such as MP3 players, and mobile telephones have become increasingly popular, and the features on the devices have become more sophisticated and numerous. The market for accessories for such devices has increased.

In one example, U.S. Pat. No. 8,086,288 discloses [a] battery-powered miniature wireless headset [that] is worn as a single earring or as a pair of earrings. The headset communicates with a phone or other host over a bidirectional wireless communication link allowing hands-free operation. The wireless earring headset is comprised of an electronics module (18), a speaker assembly (17), a microphone assembly (16), an antenna (68), a battery (62), user interface devices such as a switch (28) and LED (30), and an attachment means employing either a clamp or a pierced earring post (24) with clutch (26). The electronics module, which may be a single chip, comprises a wireless transceiver, a processor with associated memory, an audio codec, power supply electronics, and other components. In use the device is attached to the pinna of the wearer's ear (99) using either a clamp or a post inserted through a pinna piercing and secured by a clutch or nut.

In another example, U.S. Pat. No. 7,693,295 provides a system for securing headphones, the system comprising: a first transducer device having a first mechanical housing, said first mechanical housing having an outer surface and an inner surface; a first coupling device affixed to the outer surface of said first mechanical housing of said first transducer device; a second transducer device having a second mechanical housing, said second mechanical housing having an outer surface and an inner surface; and a second coupling device affixed to the outer surface of said second mechanical housing of said second transducer device, wherein said first coupling device is coupled to said second coupling device when in close proximity to each other, such that the inner surfaces of said first and second mechanical devices are opposed to each other.

In another example, U.S. Pat. No. 7,436,974 provides a system for modifying a preexisting headphone transducer having a wire connected thereto, the system comprising: a first backing device having an inner surface and an outer surface, and comprising: a first conductive material at least partially covering the inner surface of said first backing device; a bonding layer at least partially disposed on said first conductive material; and a coupling device affixed to the outer surface of said first backing device; and a second backing device having an inner surface and an outer surface, and comprising: a second conductive material at least partially covering the inner surface of said second backing device, wherein said first backing device is affixed to one side of the wire of the headphone transducer and said second first backing device is affixed to the other side of the wire of the headphone transducer, and said backing devices mate with each other to securely attach to the wire of the headphone transducer.

In another example U.S. Pat. No. 6,473,946 provides a magnetic clasp comprising a bolting member and a locking member, wherein, the bolting member including a container, a bolting rod, a first magnetic element, and a second magnetic element; a through hole being provided in the container; both ends of the bolting rod having different outer diameters; the bolting rod, the first magnetic element and the second magnetic element being received in sequence in the container; the bolting rod having its smaller end to penetrate the through hole of the container and its larger end being restricted inside the container and holding against the first magnetic element; both of the first and the second magnetic elements rejecting each other due to opposite magnetism; a through hole being provided in the locking member; the bolting rod penetrating the through hole of the locking member and to lock up by having the locking member attracted by the first magnetic element.

In another example, U.S. Pat. No. 6,640,398 provides a clasp for selectively joining a first element to a second element, the clasp comprising: a) a first generally elongated body member having opposed first and second ends and comprising a flange located at one of the ends, the flange for receiving the first element; and b) a second generally elongated body member having opposed first and second ends and comprising a flange located at one of the ends, the flange for receiving the second element; wherein each body member further comprises: (i) a generally semi-cylindrical elongated frame of nonmagnetic material, the frame having an internal semi-cylindrical coaxial channel and comprising a disk-like end member and a cylindrical end member which are located at opposite ends of the channel, and (ii) at least one magnet located within the channel for selectively securing the body members to each other through a common magnetic field.

In another example, U.S. Pat. No. 5,008,984 provides a jewelry closure comprising: first and second closure members for engaging together wherein at least one of said closure members comprises a magnet; casing means for supporting said first closure member and extending outwardly for supporting said second closure member; and means located on said casing means for engaging adjacent an outer end surface of said second closure member when said second closure member is held by magnetic attraction to said first closure member, said engaging means comprising an elongated member having a first end hinged to said casing means and a second end which lies adjacent said outer end surface of said second closure member when said jewelry closure is in secured position, wherein said hinged means is engaged with a protrusion on said casing means when said jewelry closure is in secured position; whereby said closure members cannot be separated from magnetic engagement with each other until after said engaging means is released from its position adjacent said second closure member.

In another example, U.S. Patent Application US20090016559A1 discloses a [w]earable holding apparatus and methods for securing and storing wireless or wired telecommunication and electronic devices. The apparatus includes a holding unit attached on a user's body or the clothing or accessories of a user or otherwise proximate to the user and having one or more cords attached to the device during both use and non-use.

In another example, U.S. Patent Application US20080075316A1 discloses [o]rnamental ear wrap . . . devices . . . Variations include an ear wrap having an ornamental body attachment . . . portion and an earphone attachment portion.

In another example, U.S. Patent Application US20070291974A1 discloses [a]n earpiece incorporating a small speaker for use with an electronic device that generates audio signals, such as a cell phone, digital recording player, tape player or the like, which is adapted to be inserted in or held over a wearer's ear by a head strap, includes a jewelry-like decorative attachment secured to the outer side of the earpiece, so as to give the appearance of an earring. The decorative accessory may be removably attached to the earpiece by a separable fastener such as a snap fastener clip, magnetic clamp, Velcro fastener or the like. The decorative accessory may incorporate one or more light sources in the form of LEDs or the like, powered by a battery secured in either the earpiece of the accessory itself or an inline on/off volume control switch housing assembly. The light source may be powered constantly or intermittently based on motion of the wearer, sounds or the like.

In another example, U.S. Patent Application US20040209576A1 discloses a decorative headset for a cellular phone [that] has metallic covers on the earpiece and the microphone. The metallic covers are formed to have an outer surface topography of raised and/or lowered portions. Decorative material is placed between the raised or within the lowered portions of the outer surface.

In another example, the website http://direct.motorola-.com/hellomoto/h9/discloses a BLUETOOTH® enabled headset.

In another example, the website http://www.alibaba.com/product-gs/376071581/Lovely_colorful_wooden_beads_stereo_necklace.html discloses a wooden bead stereo necklace headphone.

In another example, the website http://www.alibaba.com/product-gs/395078004/Lovely_perple_crystal_beads_necklace_for.html discloses a bead stereo necklace headphone.

SUMMARY

In one embodiment, the present invention provides a necklace comprising:

a. a means to connect the necklace to a signal source;
b. a first wire exiting the signal source connection means, connected to a first headphone;
c. a first half of a fastening means on the first wire, at a distance from the signal source connection means;
d. a second wire exiting the signal source connection means, connected to a second headphone; and
e. a second half of a fastening means on the second wire, at a distance from the signal source connection means.

In one embodiment, the first wire exiting the signal source connection means is connected to a microphone and to a first headphone. In an alternate embodiment, the second wire exiting the signal source connection means is connected to a microphone and to a second headphone.

The distance from the signal source connection means where the first and second halves of the fastening means are placed is sufficient to allow the necklace to be worn around the neck of the wearer when the necklace is closed. In one embodiment, the wearer is able to select the distance. In one embodiment, the fastening means is always fastened but capable of lengthening and/or shortening the necklace loop.

In one embodiment, the wire is decorated, so as to form an item of jewelry. The fastening means may form part of the decoration. Alternatively, the fastening means may be the decoration.

In one embodiment, the first half of the fastening means is a magnet of a first polarity, and the second half of the fastening means is a second magnet of an opposite polarity to the first magnet.

In one embodiment, the fastening means is a slider wherein the first wire and the second wire are permanently enclosed within the slider, the slider allowing either or both of the first wire and second wire to slide to lengthen and/or shorten the overall necklace loop.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person of ordinary skill in the art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

For clarity of disclosure, and not by way of limitation, the detailed description of the invention is divided into the following subsections that describe or illustrate certain features, embodiments or applications of the present invention.

Definitions

"Headphones" as used herein refers to a pair of small loudspeakers, or less commonly a single speaker, held close to a user's ears and connected to a signal source such as an audio amplifier, radio, CD player or portable media player. They are also known as stereophones, headsets or, colloquially, cans.

"Headset" as used herein refers to a combination of headphone and microphone used for two-way communication, for example with a telephone.

"Audio source" as used herein refers to any electronic device capable of delivering an audio signal to the user and/or receiving an audio signal from the user.

"Signal source" as used herein refers to any electronic device capable of delivering a signal to the user and/or receiving a signal from the user.

"Jewelry" as used herein refers to an article made from materials suitable to form decorations which may include, in any configuration, glass, such as fused-glass or enamel; wood, often carved or turned; shells and other natural animal substances such as bone and ivory; natural clay; polymer clay; plastics; gemstones; precious metals; metals; leather; rawhide, and the like for use as personal adornment that has no other purpose than to look appealing except as specifically modified by the present invention as described herein.

In one embodiment, the present invention employs a first and second signal transducer, allowing the wearer of the jewelry of the present invention to perceive the signal from an external signal source.

The jewelry of the present invention may be in the form of for example, a bracelet, a necklace, earrings, and the like. While one of ordinary skill in the art can appreciate the many embodiments of the jewelry of the present invention; for clarity, the present invention is described in detail below using a necklace.

In one embodiment, the present invention provides a necklace comprising:

a. a means to connect the necklace to a signal source;
b. a first wire exiting the signal source connection means, connected to a first signal transducer;
c. a first half of a fastening means on the first wire, at a distance from the signal source connection means;
d. a second wire exiting the signal source connection means, connected to a second signal transducer; and
e. a second half of a fastening means on the second connection, at a distance from the signal source connection means.

In one embodiment, the first wire exiting the signal source connection means is connected to a microphone and to a first signal transducer. In an alternate embodiment, the second wire exiting the signal source connection means is connected to a microphone and to a second signal transducer.

Figure 7:
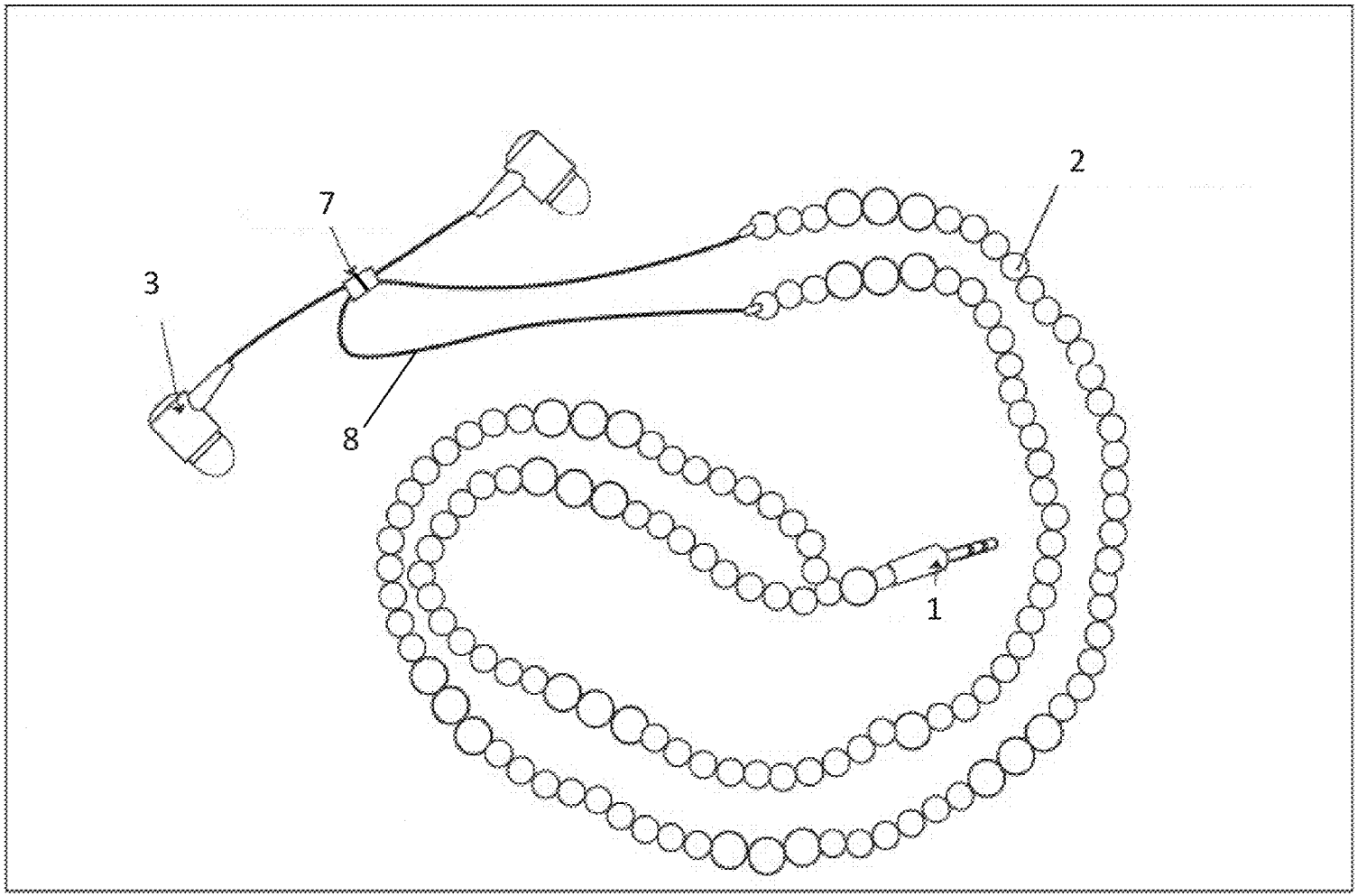
FIG. 7 shows an alternate embodiment of a necklace of the present invention depicting one means to connect the necklace to an external signal source (1); decorative beads (2); earbuds style headphones (3); and a fastening means (7) that is able to slide down the wire (8), thus altering the length of the necklace.
Figure 8:
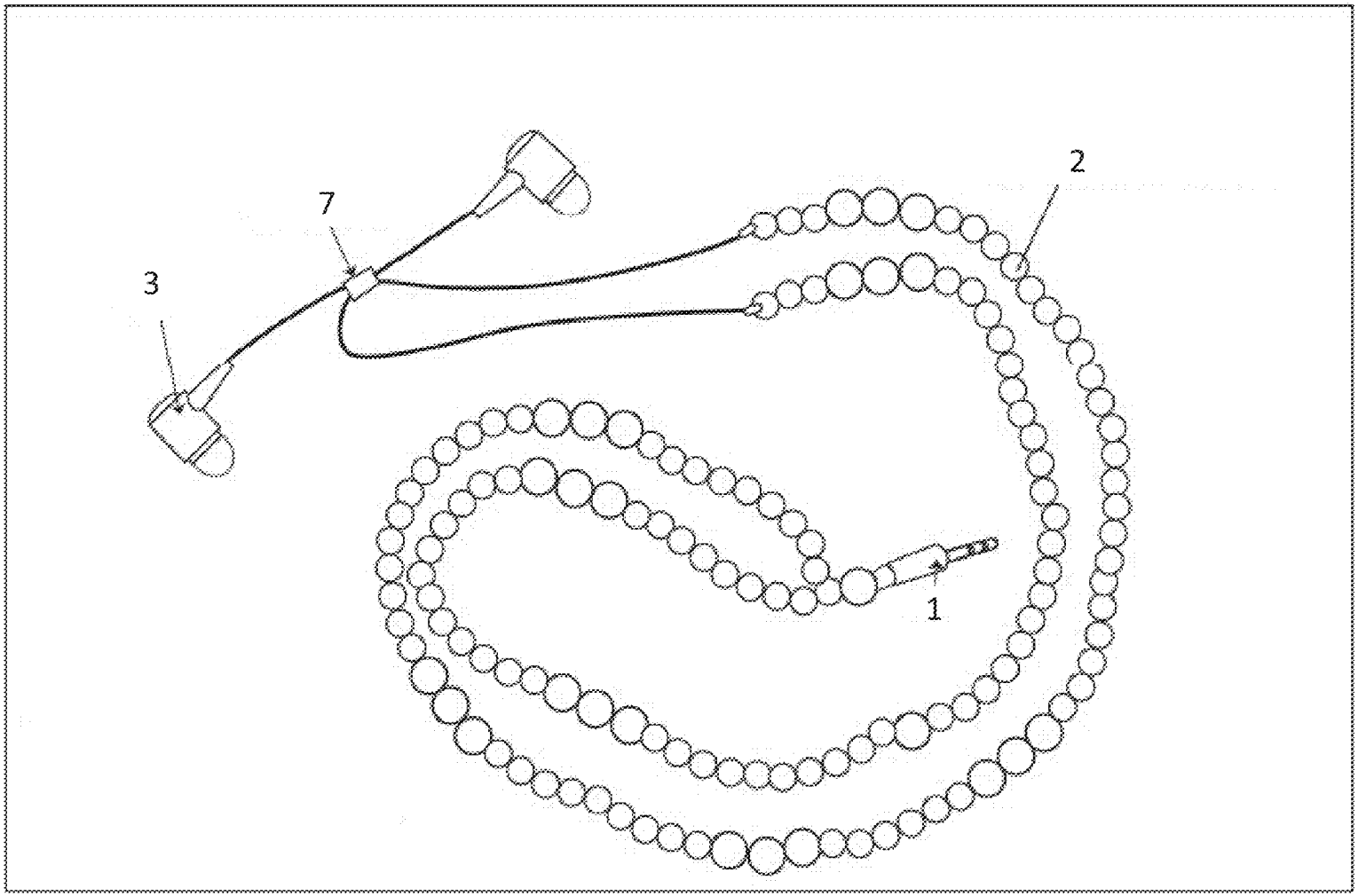
FIG. 8 shows an alternate embodiment of a necklace of the present invention depicting one means to connect the necklace to an external signal source (1); decorative beads (2); earbuds style headphones (3); and a fastening means (7) that is able to slide down the first and second wire, thus altering the length of the necklace.
Figure 9:
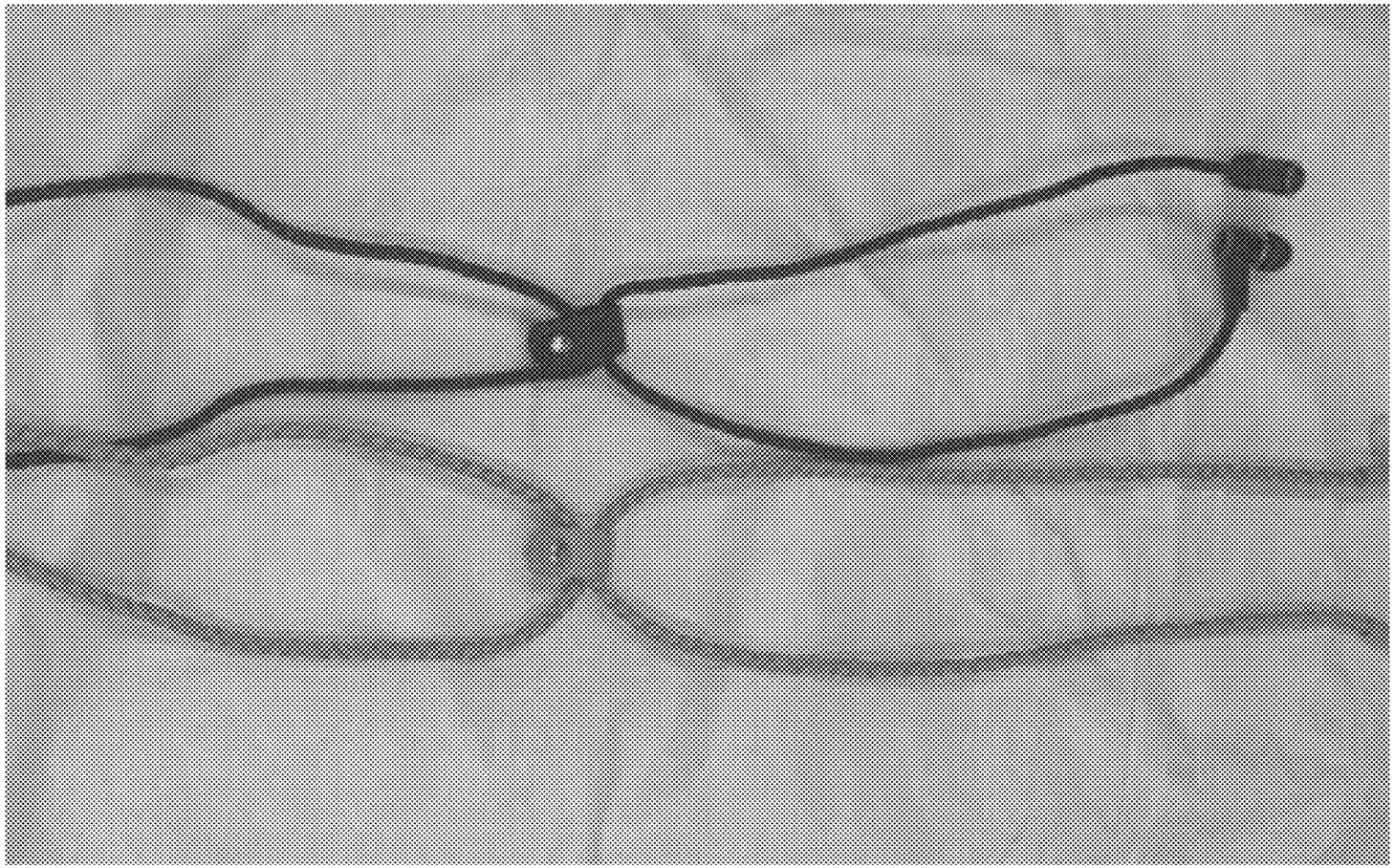
FIG. 9 shows alternative embodiments of necklaces of the present invention depicting examples of the slider fastening means. It will be appreciated by one of skill in the art that the examples provided herein do not limit the various configurations of shapes, colors, materials and arrangements of decorative elements that may be encompassed by the apparatus of the present invention.

The distance from the signal source connection means where the first and second halves of the fastening means are placed is sufficient to allow the necklace to be worn around the neck of the wearer when the necklace is closed. In one embodiment, the wearer is able to select the distance. In one embodiment of the present invention where the wearer is able to select the distance, the first half of the fastening means is able to slide on the first wire, and the second half of the fastening means is able to slide on the second wire. In one embodiment, the necklace wherein the first half of the fastening means is able to slide on the first wire, and the second half of the fastening means is able to slide on the second wire is the necklace shown in FIG. 7. In one embodiment of the present invention where the wearer is able to select the distance, the fastening means is able to slide on the first and second wire. In one embodiment, the necklace wherein the fastening means is able to slide on the first and second wire is the necklace shown in FIG. 8.

In one embodiment, the wire is decorated, so as to form an item of jewelry. The fastening means may form part of the decoration. Alternatively, the fastening means may be the decoration.

Signal Transducer

In one embodiment, the present invention employs a first and second signal transducer, allowing the wearer of the jewelry of the present invention to perceive the signal from an external signal source. Any signal transducer capable of producing a signal capable of being perceived by the wearer is suitable for use in the present invention. In one embodiment, the signal transducer is a speaker. In one embodiment, the speaker is a headphone.

Any headphone is suitable for use in a necklace of the present invention. In one embodiment, a necklace of the present invention has a single headphone. In an alternate embodiment, a necklace of the present invention has two headphones. In one embodiment, the at least one headphone is worn in the wearer's ear. The at least one headphone may reduce unwanted ambient sounds, either passively by soundproofing, or via active noise control.

In an alternate embodiment, any headphone of the present invention may be a speakerphone, such that the wearer need not insert the headphone into their ear.

In one embodiment, the necklace of the present invention uses a non-audible alert, such as, for example, vibration, to alert the wearer of a desired event, such as, for example, an incoming telephone call.

In one embodiment, the fastening means is added to prefabricated headphones to form a necklace of the present invention.

In one embodiment, the decoration is added to pre-fabricated headphones to form a necklace of the present invention.

In one embodiment, the jewelry of the present invention is the jewelry sold under the trade name HANDCANDY™

Signal Source Connection Means

The necklace of the present invention may be used with any external signal source, such as, for example, MP3 players, cellular telephones, radios, CD players, walkie-talkies, and the like. In one embodiment, the telephone is capable of playing music. For music playing telephones, the necklace can have two headphones. The signal can be any signal, including, for example, video, audio and the like.

In one embodiment, the signal source connection means transfers an audio signal to the headphones from a connected signal source. In the case where the necklace of the present invention is a headset, the signal source connection means transfers an audio signal from the microphone to the signal source.

The signal source connection means may be any suitable means of transferring signals, such as, for example, a headphone jack, a USB connection. In one embodiment, the signal source connection means is wireless. In one embodiment, the signal source connection means is the proprietary open wireless technology standard for exchanging data over short distances (using short wavelength radio transmissions in the ISM band from 2400-2480 MHz), sold under the trademark BLUETOOTH®.

Fastening Means Suitable for Use in the Present Invention

Any fastening means suitable for securing jewelry may be used. In one embodiment, the fastening means temporarily secures a necklace of the present invention around the neck of a wearer. In an alternate embodiment, a necklace is secured around the neck of the wearer whilst the at least one headphone is being used. In one embodiment, a necklace of the present invention is secured around the neck of the wearer when the at least one headphone is not being used. In one embodiment, the fastening means reduces the weight of the at least one headphone on the ear of the wearer.

In one embodiment, the fastening means is a clasp. In one embodiment, the fastening means is a hook and loop fastening system. In an alternate embodiment, the fastening means is the hook and loop fastening system, sold under the trade name VELCRO®. In one embodiment, the fastening means is a slider wherein the first wire and second wire are permanently fastened and form a closed loop but are capable of lengthening and/or shortening the necklace loop by sliding either or both the first and second wire through the slider fastener.

In one embodiment, the fastening means employs magnets to temporarily secure a necklace of the present invention to the wearer. In one embodiment of the present invention, the necklace comprises:

a. a signal source connection means;
b. a first wire exiting the signal source connection means that is connected to a first signal transducer;
c. a first magnet on the first wire, of a first polarity, at a distance from the signal source connection means;
d. a second wire exiting the signal source connection means that is connected to a second signal transducer; and
e. a second magnet on the second wire, of a polarity opposite to the first magnet, at a distance from the signal source connection means.

In one embodiment, the first signal transducer is a headphone.

In one embodiment, the second signal transducer is a headphone.

In one embodiment, the first wire exiting the signal source connection means is connected to a microphone and to a first headphone. In an alternate embodiment, the second wire exiting the signal source connection means is connected to a microphone and to a second headphone.

When the first magnet is placed in close proximity to the second magnet, a tight bond is formed between the first and second magnets, such that the first and second wire form a closed loop, thus closing the necklace. In one embodiment, the tight bond that is formed is temporary, such that the first and second magnets can be separated, allowing the wearer to remove the jewelry.

The distance from the signal source connection means where the first and second magnets are placed is sufficient to allow the necklace to be worn around the neck of the wearer when the necklace is closed. In one embodiment, the wearer is able to select the distance. In one embodiment of the present invention where the wearer is able to select the distance, the first half of the fastening means is able to slide on the first wire, and the second half of the fastening means is able to slide on the second wire. In one embodiment, the necklace wherein the first half of the fastening means is able to slide on the first wire, and the second half of the fastening means is able to slide on the second wire is the necklace shown in FIG. 7. In one embodiment of the present invention where the wearer is able to select the distance, the fastening means is able to slide on the first and second wire. In one embodiment, the necklace wherein the fastening means is able to slide on the first and second wire is the necklace shown in FIG. 8.

The first and second magnet may be attached to the wires exiting the signal source connection means using any well known and suitable bonding means. In one embodiment, the first wire is threaded through the first magnet and the second wire is threaded through the second magnet.

The size, shape, strength, or any combination thereof of the first and second magnet may be selected by one of ordinary skill in the art. Factors considered in selecting the size, shape, strength, or any combination thereof of the first and second magnet may include, for example, the design and weight of the necklace.

In the embodiments where first and second magnets provide the fastening means, the fastening means can be strictly functional, or, alternatively, the fastening means can be modified to impart decoration to the necklace of the present invention. For example, the first and second magnet may each resemble one half of a bead, which would form a bead when the first and second magnets are placed in close proximity to each other. In such instances, one of ordinary skill in the art could fashion the magnets out of any material, or combination of materials that could provide both the magnetic properties and the desired decorative properties.

For example, the magnetic material may be imbedded in material such as, for example, in any configuration, glass, such as fused-glass or enamel; wood, often carved or turned; shells and other natural animal substances such as bone and ivory; natural clay; polymer clay; plastics; gemstones; precious metals; metals; leather; rawhide, and the like. Alternatively, the magnetic material itself may be decorative.

Figure 1:
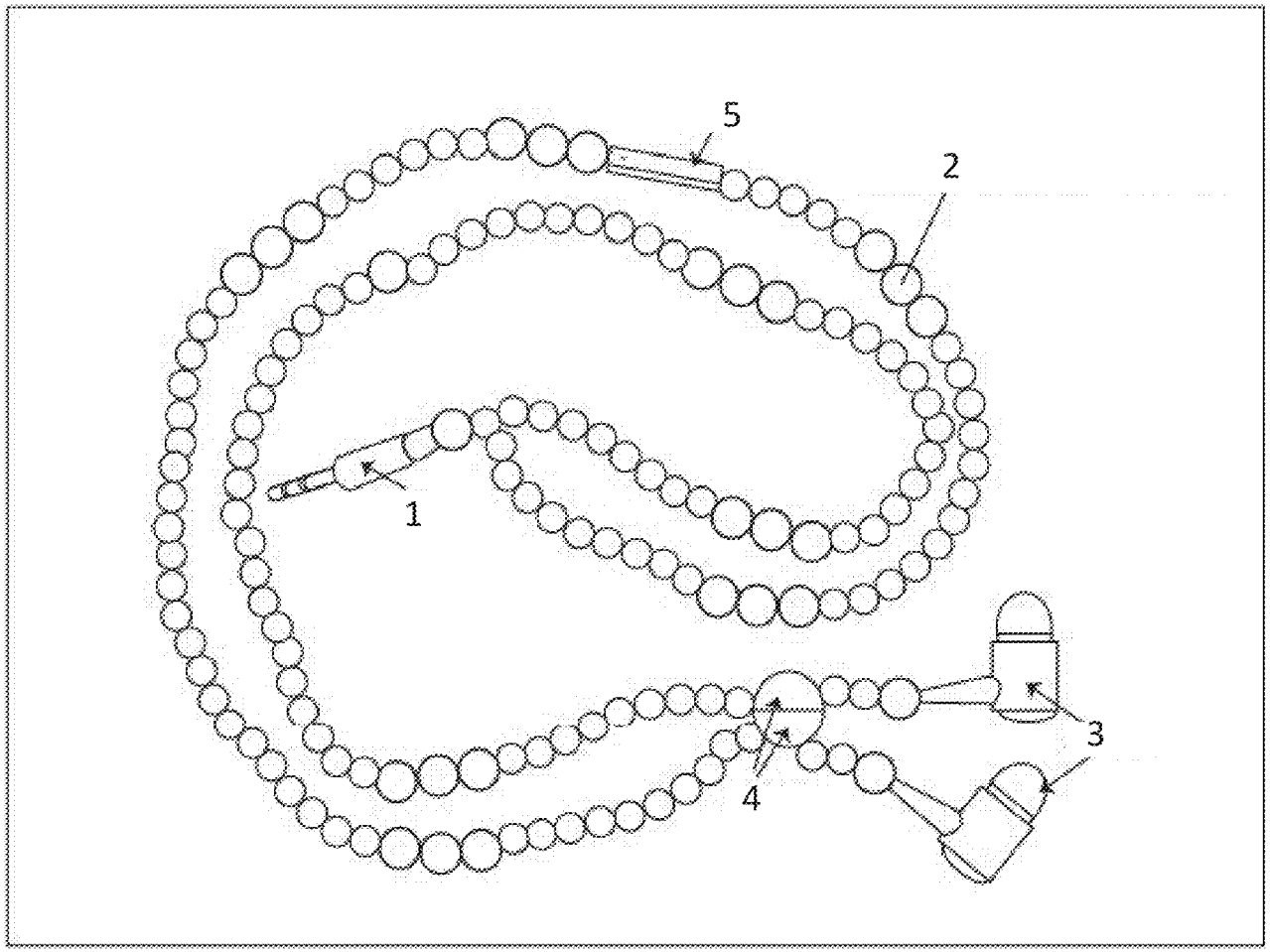
FIG. 1 shows one embodiment of a necklace of the present invention depicting one means to connect the necklace to an external signal source (1); decorative beads (2); earbuds style headphones (3); two halves of the magnetic clasp (4); and microphone (5).
Figure 2:
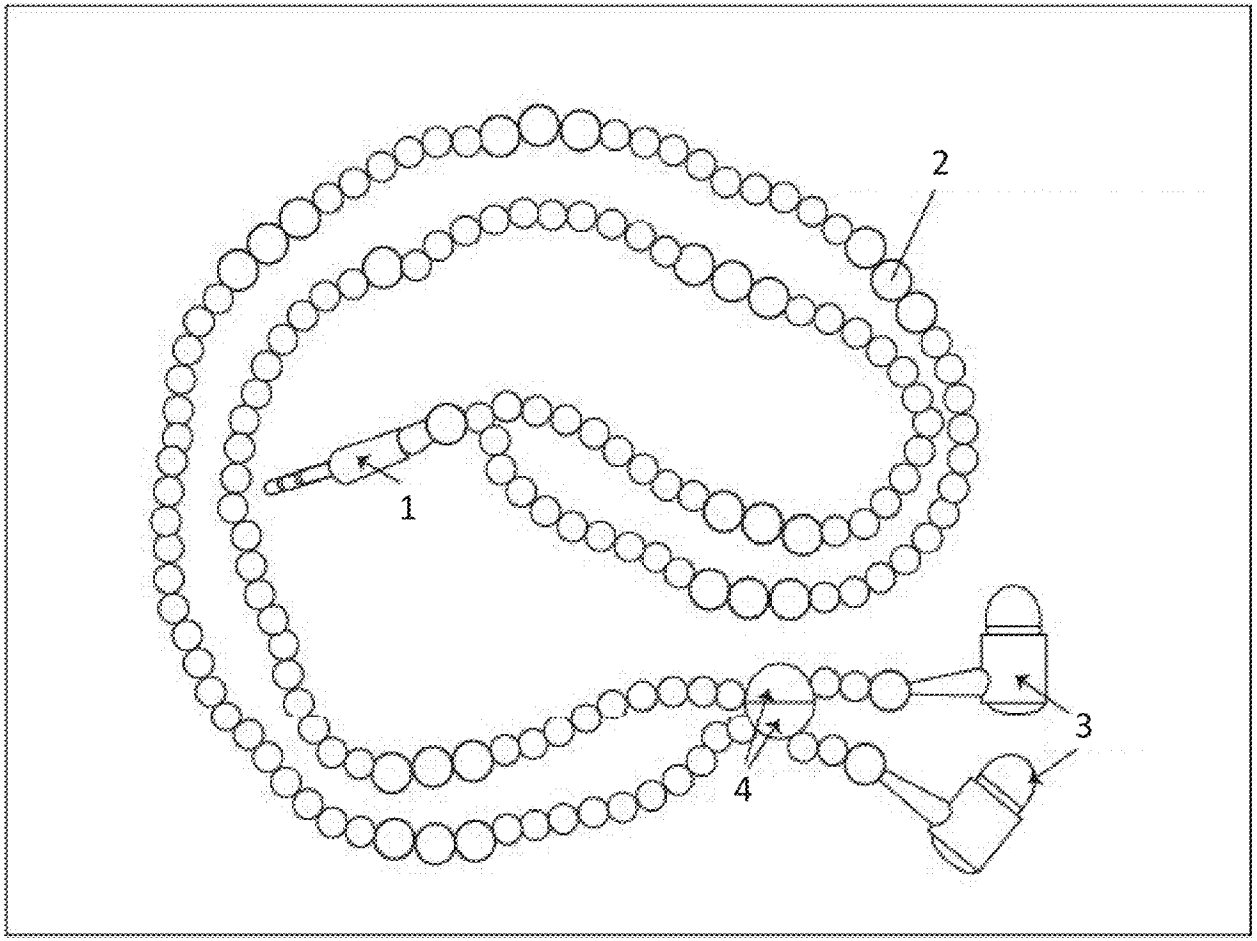
FIG. 2 shows an alternate embodiment of a necklace of the present invention depicting one means to connect the necklace to an external signal source (1); decorative beads (2); earbuds style headphones (3); and two halves of the magnetic clasp (4).
Figure 3:
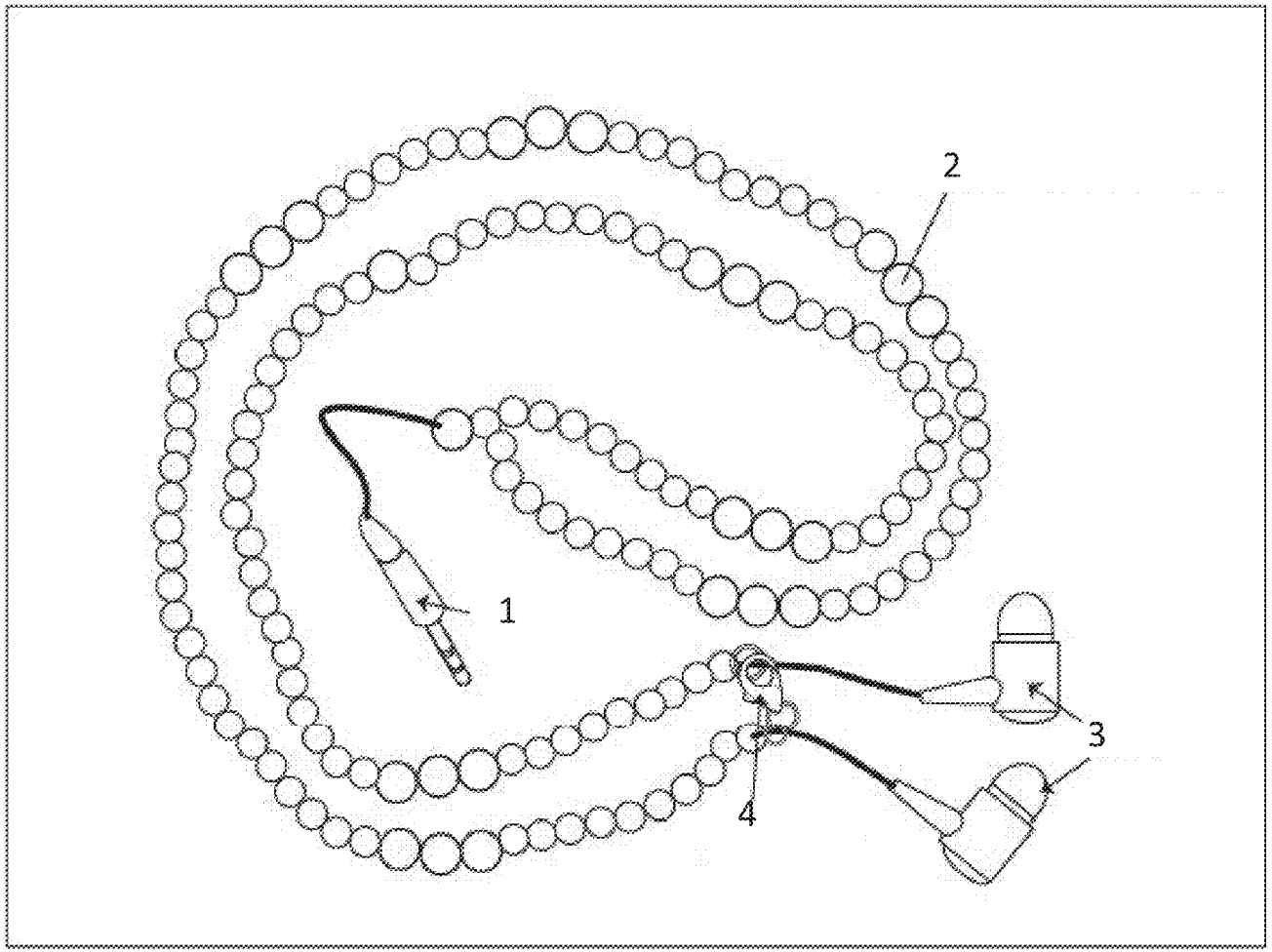
FIG. 3 shows an alternate embodiment of a necklace of the present invention depicting one means to connect the necklace to an external signal source (1); decorative beads (2); earbuds style headphones (3); and an alternate spring loaded jewelry clasp (4).
Figure 4:
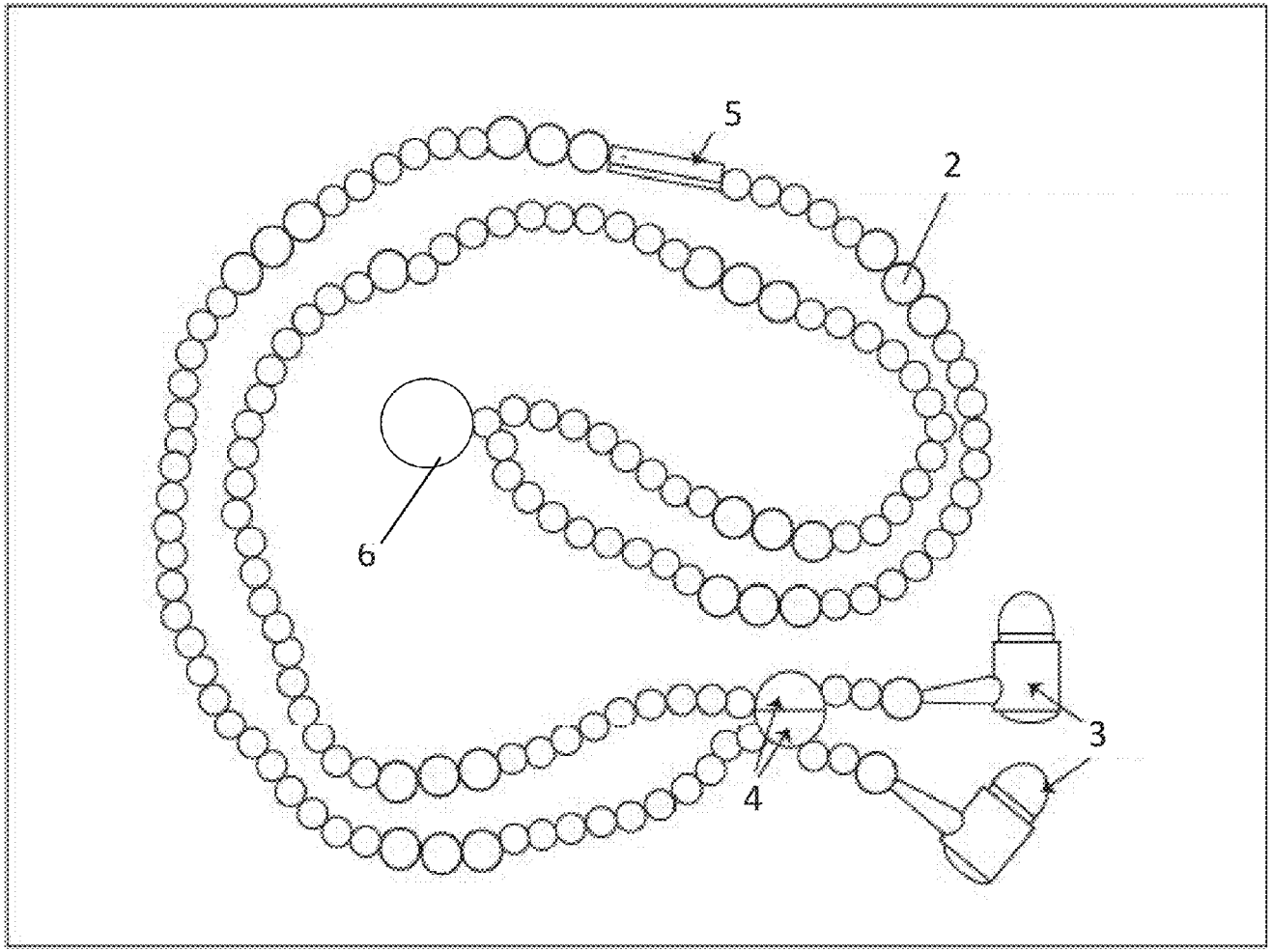
FIG. 4 shows an alternate embodiment of a necklace of the present invention depicting a wireless means to connect the necklace to an audio source (6); decorative beads (2); earbuds style headphones (3); two halves of the magnetic clasp (4); and microphone (5).
Figure 5:
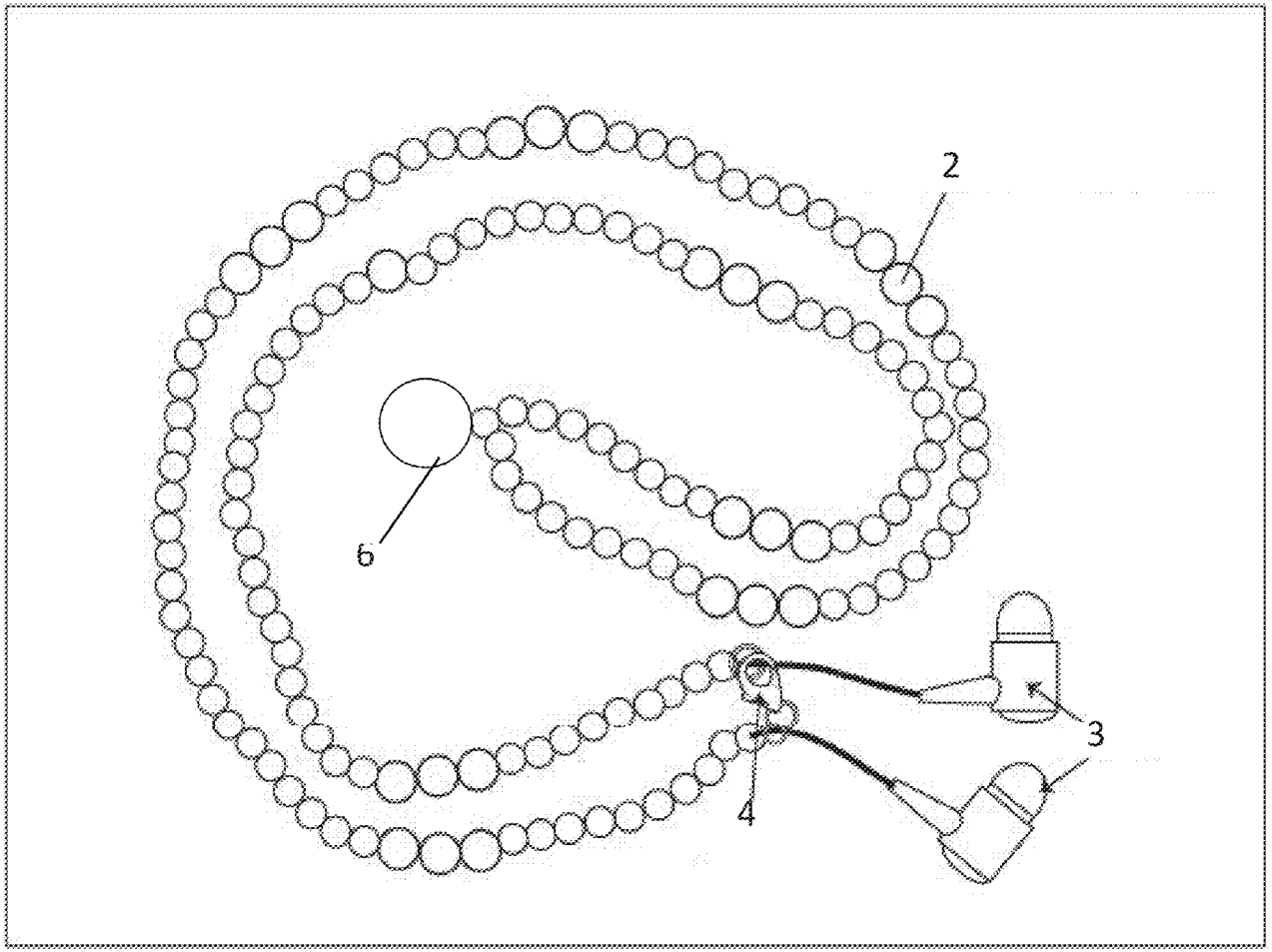
FIG. 5 shows an alternate embodiment of a necklace of the present invention depicting a wireless means to connect the necklace to an external signal source (6); decorative beads (2); earbuds style headphones (3); and an alternate spring loaded jewelry clasp (4).
Figure 6:
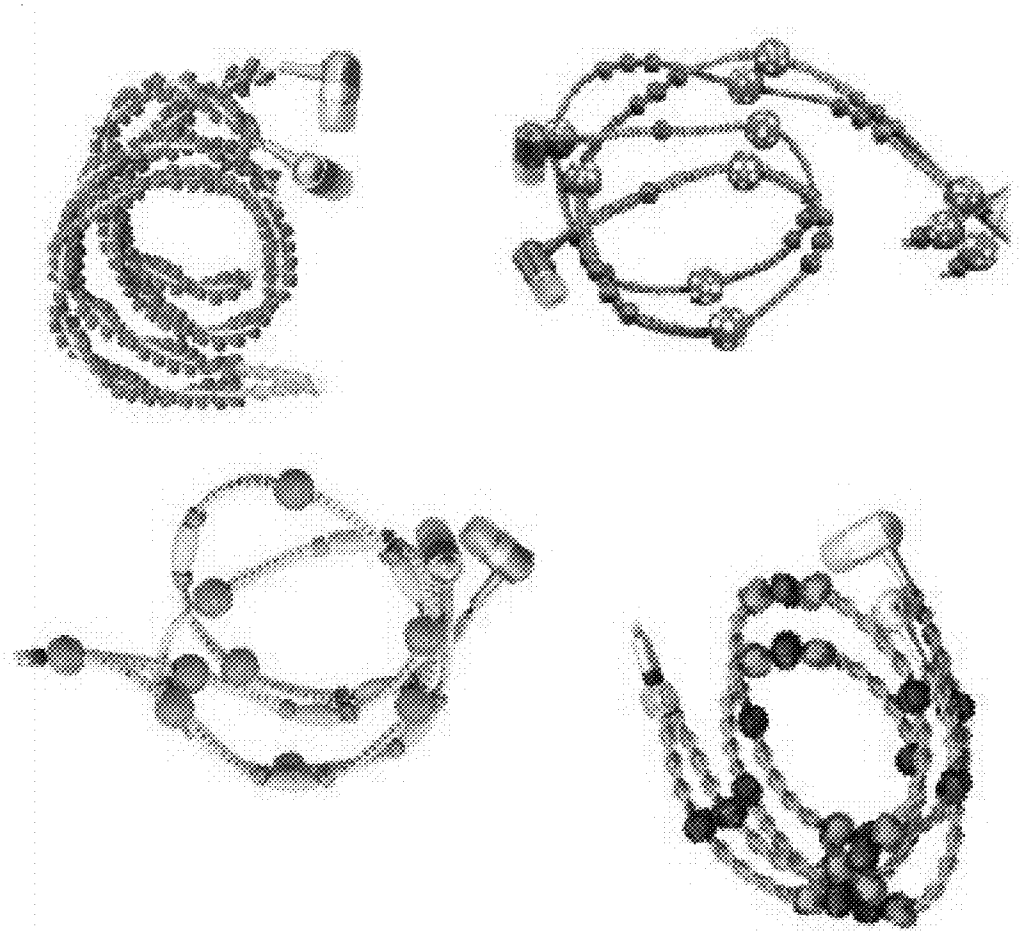
FIG. 6 shows alternative embodiments of necklaces of the present invention depicting various decorative arrangements. It will be appreciated by one of skill in the art that the bead examples depicted herein do not limit the various configurations of shapes, colors, materials and arrangements of decorative elements that may be encompassed by the apparatus of the present invention.

The size and shape of the fastening means is not limited, provided the fastening means is able to form a temporary means to secure a necklace to the wearer. Examples of fastening means suitable for use in the present invention are shown in FIG. 6. The fastening means depicted in FIG. 6 serve as examples and do not limit the invention in any way.

In an alternate embodiment, the fastening means is the fastening means disclosed in U.S. Pat. No. 5,008,984.

In an alternate embodiment, the fastening means is the fastening means disclosed in U.S. Pat. No. 6,640,398.

In an alternate embodiment, the fastening means is the fastening means disclosed in U.S. Pat. No. 6,473,946.

Decoration Suitable for Use in the Present Invention

The necklace of the present invention may be decorated in any manner, including for example, beads, ornaments, and the like. In one embodiment, the necklace of the present invention is decorated with beads. The beads may be made out of any material and may be any shape and may be any color. Materials suitable to form decorations may be any shape and may be any color and may include, in any configuration, glass, such as fused-glass or enamel; wood, often carved or turned; shells and other natural animal substances such as bone and ivory; natural clay; polymer clay; plastics; gemstones; precious metals; metals; leather; rawhide, and the like. The combination and choice of decorations may be selected by the wearer.

Examples of decoration suitable for use in the present invention are shown in FIG. 6. The decoration depicted in FIG. 6 serve as examples and do not limit the invention in any way.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

What is claimed is:

1. Jewelry comprising:

a. a means to connect the jewelry to a signal source;

b. a first wire exiting the means to connect the jewelry to a signal source, connected to a first signal transducer;

c. a first magnet of a first polarity on the first wire, at a distance from the signal source connection means;

d. a second wire exiting the signal source connection means, connected to a second signal transducer;

e. a second magnet of a polarity opposite to the first magnet on the second wire, at a distance from the signal source connection means; wherein connecting the first and second magnet forms a first lanyard enabling the jewelry to be worn about a person, and wherein the jewelry lacks a second lanyard.

* * * * *